US010987270B2

(12) United States Patent
Rideout

(10) Patent No.: US 10,987,270 B2
(45) Date of Patent: Apr. 27, 2021

(54) ORTHOPEDIC EXERCISE APPARATUS

(71) Applicant: Michael Rideout, Towson, MD (US)

(72) Inventor: Michael Rideout, Towson, MD (US)

( * ) Notice: Subject to any disclaimer, the term of this patent is extended or adjusted under 35 U.S.C. 154(b) by 351 days.

(21) Appl. No.: 15/904,742

(22) Filed: Feb. 26, 2018

(65) Prior Publication Data

US 2019/0262210 A1 Aug. 29, 2019

(51) Int. Cl.

| | |
|---|---|
| ***A61H 1/02*** | (2006.01) |
| ***A63B 21/00*** | (2006.01) |
| *A63B 22/00* | (2006.01) |

(52) U.S. Cl.

CPC ..... *A61H 1/0255* (2013.01); *A63B 21/00181* (2013.01); *A63B 21/4041* (2015.10); (Continued)

(58) Field of Classification Search

CPC ..... A61H 1/0255; A61H 1/0266; A61H 2201/1642; A61H 1/0218; A61H 1/0237; A61H 1/024; A61H 2201/1253; A61H 2205/102; A61H 2201/0192; A61H 2203/0431; A61H 1/005; A61H 1/006; A61H 1/0244; A61H 2201/164; A61H 2203/0425; A61H 2201/0431; A61H 2205/10–106; A63B 21/00181; A63B 21/4041; A63B 21/00178; A63B 2208/0233; A63B 2022/0094; A63B 1/00; A63B 21/00; A63B 21/4011–4015; A63B 21/0004; A63B 21/00047; A63B 21/4029; A63B 21/4037–4039; A63B 23/0211; (Continued)

(56) References Cited

U.S. PATENT DOCUMENTS

| | | | |
|---|---|---|---|
| 2,772,881 | A | 12/1956 | Fundom et al. |
| 3,000,632 | A | 9/1961 | Fuchs |

(Continued)

OTHER PUBLICATIONS

ULINE Document (derived from: ULINE, "Diamond Plate Mats" [online], Aug. 16, 2016 [retrieved on May 8, 2020], retrieved from: https://web.archive.org/web/20160816172837/http://www.uline.com/BL_1761/Diamond-Plate-Mats) (Year: 2016).*

(Continued)

*Primary Examiner* — Jennifer Robertson
*Assistant Examiner* — Catrina A Letterman
(74) *Attorney, Agent, or Firm* — Dinsmore & Shohl LLP

(57) ABSTRACT

The disclosed inventive concept provides an orthopedic exercise apparatus for accommodating a wheelchair-bound user and allowing the user to perform low-load prolonged stretching without getting out of his or her existing wheelchair. The apparatus includes a base having a top sheet and a bottom sheet secured thereto, and a T-shaped structure mounted to and extending perpendicular to the base. The T-shaped structure includes a stabilization post having an adjustable height and a cross-bar mounted to the top end of the stabilization post. The cross-bar is lowered onto the user's thighs in order to limit stretching to the user's knee or provide passive a dorsiflexion force to the ankle. The apparatus can be used in conjunction with a pulleyed weight station for treating knee flexion contractures or, alternatively, with a pair of ankle blocks removably fitted within the base for treating ankle plantar flexion contractures.

19 Claims, 4 Drawing Sheets

(52) U.S. Cl.
CPC . *A63B 21/00178* (2013.01); *A63B 2022/0094* (2013.01); *A63B 2208/0233* (2013.01)

(58) Field of Classification Search
CPC ..... A63B 23/0233; A63B 23/0238; A63B 2023/006
See application file for complete search history.

(56) References Cited

U.S. PATENT DOCUMENTS 4,089,330 A 5/1978 Nicolosi et al.
4,114,610 A 9/1978 Koch
4,463,947 A 8/1984 Kloenne
4,509,509 A 4/1985 Bouvet et al.
4,599,996 A 7/1986 Seith et al.
4,637,379 A 1/1987 Saringer
4,732,380 A 3/1988 Maag
4,784,121 A 11/1988 Brooks
4,822,038 A 4/1989 Maag
5,007,634 A 4/1991 Jones
5,076,576 A 12/1991 Johnston
5,100,130 A * 3/1992 Shoebrooks ..... A63B 21/4039 482/121
5,277,685 A 1/1994 Gonzales
5,289,603 A * 3/1994 Kumagai ..... A61G 7/065 128/869
5,417,636 A * 5/1995 Havens ..... A63B 21/0552 482/140
5,562,579 A 10/1996 Sheikowitz
D391,314 S * 2/1998 Cordero ..... D21/687
5,733,233 A 3/1998 Webber
6,019,740 A 2/2000 Hausman
6,203,473 B1 3/2001 Atwood
6,422,981 B1 * 7/2002 Riser ..... A63B 21/154 482/142
7,235,039 B2 6/2007 Anders
9,545,537 B2 * 1/2017 Savioli ..... A63B 21/4037
9,878,203 B1 * 1/2018 Guarnaccia ..... A63B 21/4029
2004/0014570 A1 * 1/2004 Centopani ..... A63B 21/0552 482/140
2004/0110610 A1 * 6/2004 Chen ..... A63B 23/03575 482/123
2005/0130814 A1 * 6/2005 Nitta ..... A63B 21/055 482/121
2007/0066463 A1 * 3/2007 Araujo ..... A63B 21/00181 482/142
2010/0248909 A1 * 9/2010 Thorpe ..... A63B 23/0211 482/91
2010/0299833 A1 * 12/2010 Kessler ..... A63B 21/4037 5/417
2011/0256994 A1 10/2011 Dauterive
2013/0324382 A1 * 12/2013 Wilson ..... A63B 23/0211 482/142
2017/0028242 A1 * 2/2017 Miyoshi ..... A63B 23/1209
2017/0043211 A1 * 2/2017 MacK ..... A63B 21/0428
2018/0085275 A1 * 3/2018 Malone ..... A61H 1/024
2019/0308066 A1 * 10/2019 Rusch ..... A63B 21/4039

OTHER PUBLICATIONS

ULINE Document (derived from: ULINE, "Diamond Plate Mats" [online], Aug. 16, 2016 [retrieved on May 8, 2020], retrieved from: https://web.archive.org/web/20160816172837/http://www.uline.com/BL_1761/Diamond0-Plate-Mats) (Year: 2016).*
ScienceDirect Document (derived from: Steve Zeise, "Mechanical Design" [online], 2015 [retrieved on May 9, 2020], ScienceDirect, retrieved from: https://www.sciencedirect.com/topics/engineering/threaded-fastener) (Year: 2015).*

* cited by examiner

ORTHOPEDIC EXERCISE APPARATUS

TECHNICAL FIELD

The disclosed inventive concept pertains to exercise apparatuses. More particularly, the disclosed inventive concept concerns orthopedic exercise apparatuses for facilitating low-load prolonged stretching. Even more particularly, the disclosed inventive concept pertains to an orthopedic exercise apparatus for a wheelchair-bound user and for accommodating the user's existing wheelchair.

BACKGROUND OF THE INVENTION

In the field of physical therapy and rehabilitation, joint contractures and range of motion (ROM) restrictions are prevalent, particularly in the elderly. A joint is said to have a "contracture" when there is very little to no passive motion available in its primary motion plane. Limitations in ROM of joints not only lead to mobility impairments, but, if severe enough, can lead to decubitus ulcers or bed sores, difficulty in bathing, pain, and skin maceration.

To re-establish normal joint ROM, clinicians or therapists employ a variety of tools at their disposal such as heating packs, ultrasound therapy, short-wave diathermy, and deep tissue massage. These modalities serve to increase temperature and pliability of soft tissues, but, ultimately, the joint will require stretching to lengthen the soft tissues, including tendons, ligaments, and joint capsules, to thereby increase ROM. Stretching is typically accomplished by hands-on manipulation by the therapist.

The ability to stand or ambulate is inhibited by contractures of the knee and ankle joints. Knee flexion contractures, an inability to passively extend or straighten the knee, and ankle plantar flexion contractures, an inability to passively pull the foot upward or "dorsiflex," are the most common types of contractures that hinder this type of activity. These contractures are primarily caused by the loss of the viscoelastic properties of the tendons and ligaments on the posterior aspect of the respective joints.

Soft tissues become more pliable and elongate under low intensity or "load" prolonged stretching (LLPS). It is suggested that prolonged stretches are performed for a length of time anywhere between three minutes to several hours. However, the most optimal interval of prolonged stretching is typically anywhere between 20 to 60 minutes.

Therapists may possess the strength, patience, and time to manually perform LLPS with a patient, but it is not a time-efficient practice and can be laborious. This is particularly true when a patient is wheelchair-bound and cannot easily transfer to a treatment table and/or attain a prone position. Therefore, an apparatus for accommodating those in a wheelchair for performing LLPS of the knee and ankle joints is preferred.

The prior art addressed this situation by proposing a number of therapeutic exercise apparatuses that allow those bound to a wheelchair to perform LLPS. For example, U.S. Pat. Nos. 4,732,380, 4,822,038, 5,562,579, 5,277,685, 5,733,233, and U.S. Patent Application Publication No. 2011/0256994 each teach an apparatus for providing therapeutic stretching while in a seated position. However, most of the apparatuses disclosed in the above-noted references require that the wheelchair-bound user be moved into a seat associated with the apparatus. Alternatively, of those that do accommodate a user's existing wheelchair, they do not facilitate optimal LLPS for knee and ankle plantar flexion contractures.

Therefore, in view of the state of the art, it may be advantageous to provide an orthopedic exercise apparatus that allows those bound to a wheelchair to perform LLPS. As in so many areas of physical therapy and rehabilitation, there is always room for improvement of the orthopedic exercise apparatus.

SUMMARY OF THE INVENTION

The disclosed inventive concept overcomes the problems associated with known orthopedic exercise apparatuses by accommodating a user's existing wheelchair. The disclosed inventive concept offers the significant general advantage of allowing a wheelchair-bound user to perform low-load prolonged stretching (LLPS) without having to get out of his or her wheelchair.

Particularly, the disclosed inventive concept provides an orthopedic exercise apparatus comprising a base and a T-shaped structure extending upwardly from the base. The base is preferably a rectangular piece of sheet metal with a high-density polyethylene (HDPE) sheet attached to the undersurface. Thus, the apparatus can be slid across the floor without causing damage to the floor or to the apparatus itself.

The T-shaped structure comprises a stabilization post including an outer tube mounted to the top surface of the base and an inner tube having a diameter slightly less than the outer tube. Thus, the inner tube movably fits within the outer tube and locks in place within the outer tube in order to provide the T-shaped structure with an adjustable height. The T-shaped structure also comprises a cross-bar mounted perpendicularly to the top end of the stabilization post. A foam pad is attached to the lower surface of the cross-bar and encircles that stabilization post.

Preferably, the exercise apparatus also includes a pair of spaced-apart apertures formed in the top surface of the base below the foam pad. The apertures each receive a respective ankle block having a peg which mates with the associated aperture. The ankle blocks are, therefore, able to be easily removed from the exercise apparatus when not in use.

It is to be appreciated that, when in use, the exercise apparatus is moved into position proximate a weight station with a pulley system. The wheelchair-bound user then positions himself or herself at the T-shaped structure so that the user's thighs are under the pads. The height of the T-shaped structure is adjusted based on the size of the user. Thereafter, the user's ankle is secured to a rope of the weight station via an ankle strap. A specific amount of weight on the weight station is then selected in order to raise the user's ankle and cause a stretching force to be applied to the user's knee.

Alternatively, the user can forgo the weight station and use the ankle blocks to perform LLPS on his or her ankle. In doing so, the user positions the ball of the foot on the proximal edge of an ankle block closer to the user so that the heel of the foot is unsupported. For those with a more restricted range of the ankle, and for comfort, the entire foot may be placed on the upper surface of the ankle block. The T-shaped structure is then lowered to apply a downward stretching force on the ankle joints at the user's heel.

The purpose of the T-shaped structure is to provide a constant downward force. Thus, it is not intended that the user perform alternating repetitions while using the weight station or ankle blocks. Instead, it is intended that the user maintain these extended position with respect to the knee, or dorsiflexed position with respect to the ankle, for prolonged periods to provide the greatest results. Preferably, the positions are maintained for approximately 20 to 60 minutes at a time.

The above advantages, in addition to other advantages and features, will be readily apparent from the following detailed description of the invention when taken in connection with the accompanying drawings.

BRIEF DESCRIPTION OF THE DRAWINGS

For a more complete understanding of this disclosed inventive concept, reference should now be made to the embodiments illustrated in greater detail in the accompanying drawings and described below by way of examples of the disclosed inventive concept wherein.

DETAILED DESCRIPTION OF THE INVENTION

Figure 1:
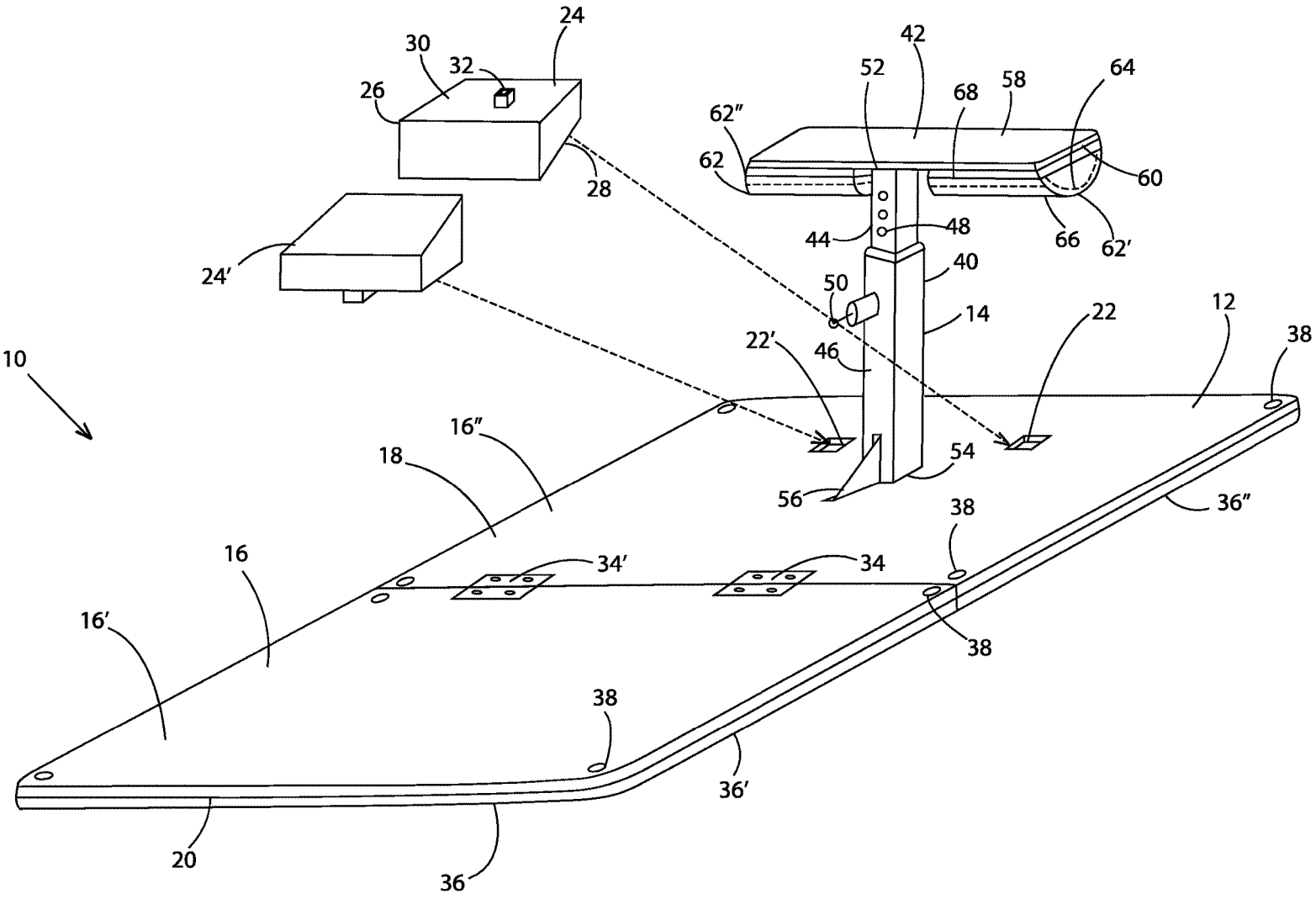
FIG. 1 is a perspective view of an orthopedic exercise apparatus in accordance with the disclosed inventive concept.

In the following figures, the same reference numerals will be used to refer to the same components. In the following description, various operating parameters and components are described for different constructed embodiments. These specific parameters and components are included as examples and are not meant to be limiting.

Figure 2:
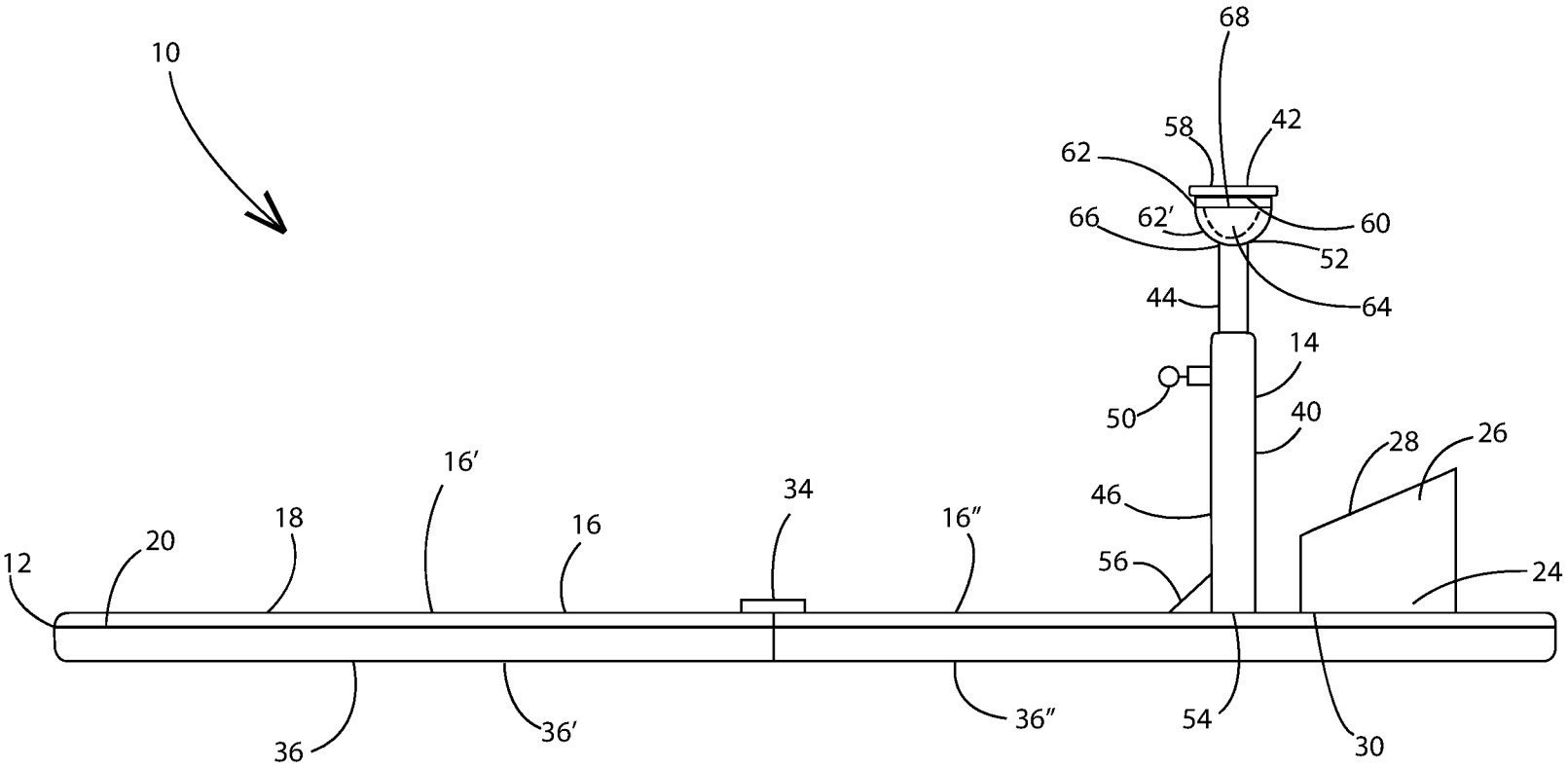
FIG. 2 is a side view of the apparatus.
Figure 3:
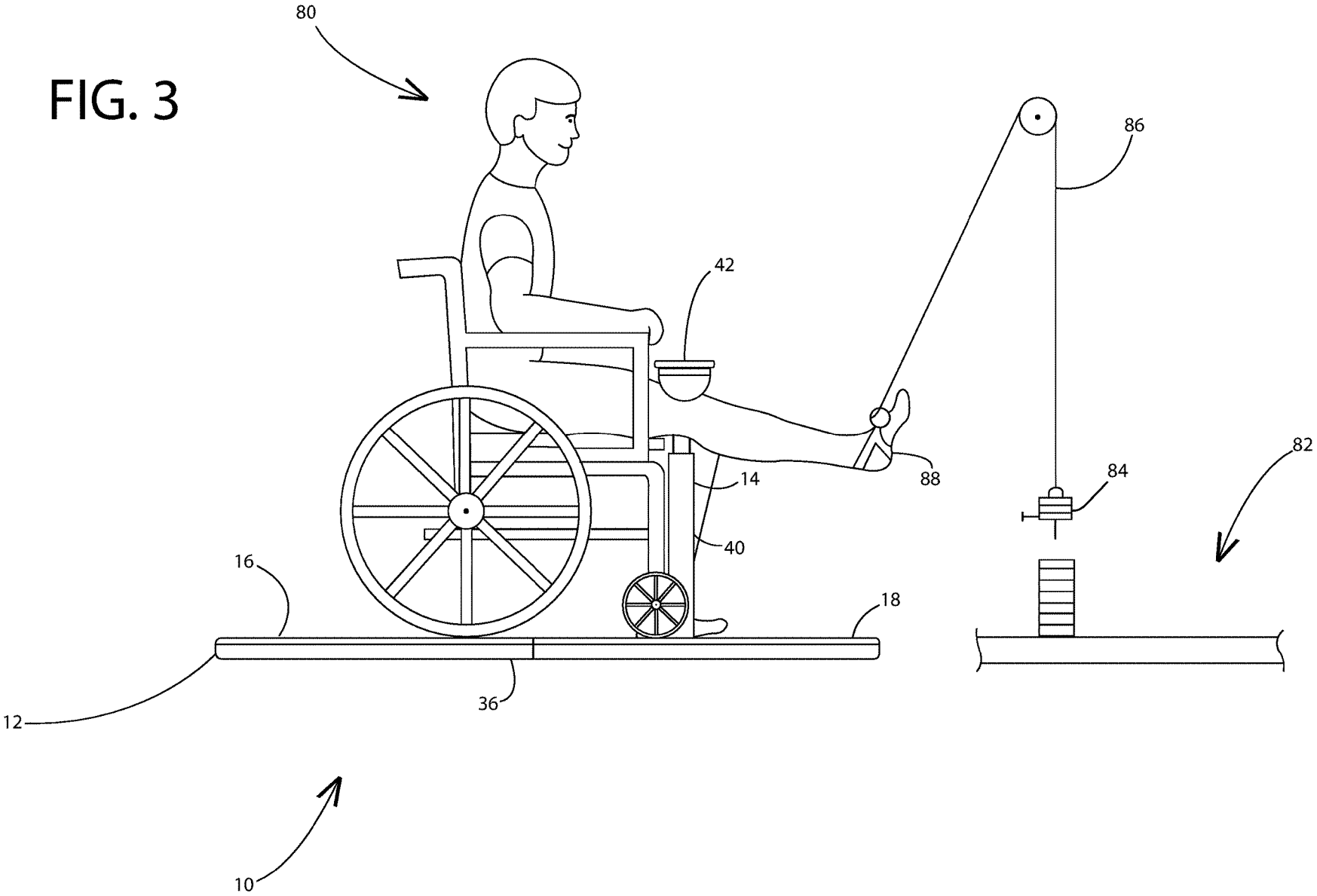
FIG. 3 is a side view of the apparatus in use and in position proximate a weight station.
Figure 4:
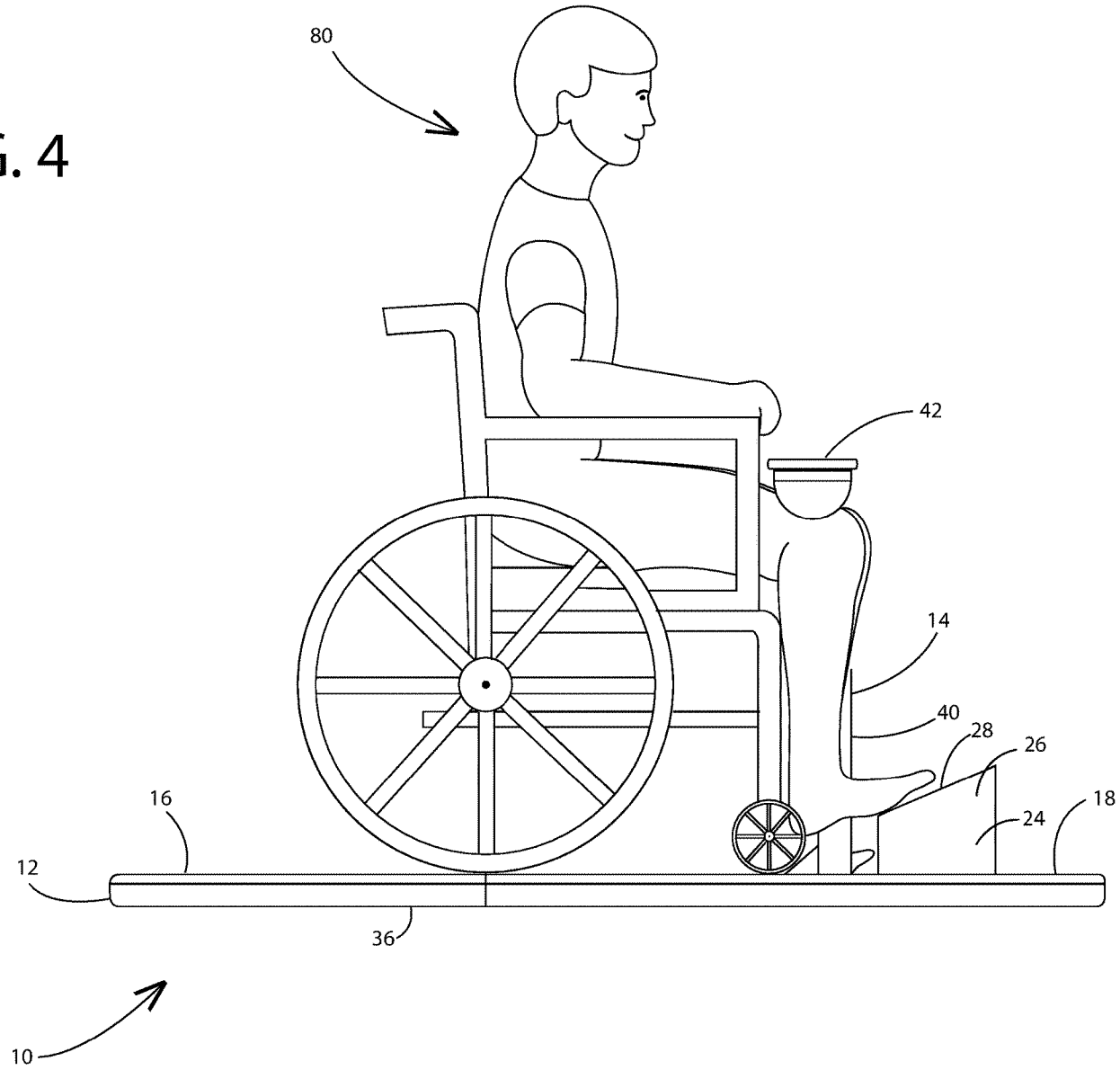
FIG. 4 is a side view of the apparatus in use with a pair of ankle blocks.

In accordance with the disclosed inventive concept and with reference to the drawings, there is provided an orthopedic exercise apparatus denoted at 10 comprising a base 12 and a T-shaped structure 14. FIGS. 1 and 2 illustrate a perspective view and a side view, respectively, of the apparatus 10, while FIGS. 3 and 4 illustrate the apparatus 10 in use.

The base 12 comprises a rectangular top sheet 16 having an upper surface 18 and a lower surface 20. Preferably, the top sheet 16 is formed from metal, such as aluminum, magnesium, steel, or titanium. Even more particularly, the top sheet 16 can be diamond plated or corrugated in order to add stiffness and provide increased friction. In order to eliminate any sharp edges on the top sheet 16, the edges and corners thereof are preferably rounded.

As shown in FIG. 1, the top sheet 16 includes a pair of apertures 22, 22' for receiving respective ankle blocks 24, 24'. The ankle blocks 24, 24' have identical structures and, therefore, only ankle block 24 will be described in detail. Ankle block 24 includes a brick portion 26 having a planar upper surface 28 and a planar lower surface 30. Preferably, the upper surface 28 is sloped toward the T-shaped structure 14. Ankle block 24 also includes a peg 32 extending perpendicularly from the lower surface 30 of the brick portion 26. The peg 32 is shaped to fit within aperture 22 and prevent rotation of the ankle block 24 while situated therein. As shown, aperture 22 and peg 32 have square cross-sections for preventing rotation of the peg 32 while fitted within the aperture 22. However, any other suitable polygonal shape or configuration may be used. It is to be understood that the ankle blocks 24, 24' are only utilized when treating ankle plantar flexion contractures, as discussed in detail below.

Furthermore, as shown in FIGS. 1 and 2, the top sheet 16 may include a first top portion 16' and a second top portion 16" separate from one another and joined by at least one hinge 34. As a result, the top sheet 16 may be folded with respect to the hinge 34, thereby reducing its dimensions for storage purposes. As shown in FIG. 1, a pair of hinges 34, 34' are used.

Preferably, the base 12 also includes a bottom sheet 36 secured to the lower surface 20 of the top sheet 16. The bottom sheet 36 is utilized to prevent accidental wear to the floor caused by the top sheet 16 when the apparatus 20 is moved across the floor. Therefore, the bottom sheet 36 is preferably formed from a smooth, low-friction material, such as high-density polyethylene (HDPE), polypropylene, polystyrene, polyvinyl chloride (PVC), and the like, which will not damage or scratch the floor slid across which the apparatus 10 is slid.

Preferably, the bottom sheet 36 is thicker than the top sheet 16. Thus, the apertures 22, 22' formed in the top sheet 16 may extend into the bottom sheet 36 for receiving longer pegs 32 of the ankle blocks 24, 24'. This allows the ankle blocks 24, 24' to be further anchored within the base 12.

When the edges and corners of the top sheet 16 are rounded, the edges and corners of the bottom sheet 36 are also rounded in order to alleviate any sharp edges. Similarly, when the top sheet 16 includes first and second top portions 16', 16" joined by a hinge 34, the bottom sheet 36 also includes a first bottom portion 36' and a second bottom portion 36" separate from one another. As a result, the bottom sheet 36 is able to fold with the top sheet 16.

The bottom sheet 36 is attached to the top sheet 16 via a plurality of fasteners or an adhesive. Preferably, the bottom sheet 36 is secured to the top sheet 16 by attachment of mechanical fasteners, such as a plurality of flat headed sheet metal screws 38, into the bottom sheet 36 through the upper surface 18 of the top sheet 16. When the bottom sheet 36 includes the first and second bottom portions 36', 36", screws 38 are located at each corner or any other suitable location thereof. The tops of the holes in the top sheet 16 formed by the screws 38 may be beveled so that the heads of the screws 38 lie flat with, or slightly below, the upper surface 18 of the top sheet 16.

As noted above, the apparatus 10 includes a T-shaped structure 14 comprising a stabilization post 40 and a cross-bar 42. The stabilization post 40 is mounted to the upper surface 18 of the top sheet 16, proximate one end of the top sheet 16, and extends upwardly and perpendicularly thereto. The stabilization post 40 includes an inner tube 44 and an outer tube 46 which cooperate to adjust the height of the stabilization post 40. The inner and outer tubes 44, 46 are formed from steel. The inner tube 44 has a diameter slightly less than the diameter of the outer tube 46 so that the inner tube 44 is movable within the outer tube 46 in order to raise and lower the cross-bar 42 mounted to the top thereof.

In order to set the height of the stabilization post 40, a plurality of equally spaced-apart holes 48 are formed in the inner tube 44. Additionally, the outer tube 46 includes a spring-loaded pin 50 that engages any one of the holes 48 in order to lock the inner tube 44 in position within the outer tube 46. Thus, the height of the stabilization post 40 is adjusted by retracting the pin 50, raising or lowering the inner tube 44, aligning the pin 50 with one of the holes 48, and releasing the pin 50 so that it engages the aligned hole 48. It is to be understood that, in an alternative embodiment, the stabilization post 40 may be configured such that the outer tube 46 is above the inner tube 46 and moves relative to the base 12 while the inner tube 46 remains stationary.

The stabilization post 40 has a top end 52 and a bottom end 54. As noted above, the bottom end 54 of the stabilization post 40 is mounted to the base 12 by any suitable means such as by using a threaded fastener or welding. For additional support, a support bracket 56 is secured to the bottom end 54 of the stabilization post 40 and the base 12. The support bracket 56 may be any suitable bracket such as an L-shaped bracket or triangular bracket.

As noted above, the stabilization post 40 includes a cross-bar 42. Preferably, the cross-bar 42 is a steel plate having rounded edges and corners. The cross-bar 42 is mounted to the top end 52 of the stabilization post 40 and perpendicular thereto. Thus, as the inner tube 44 is lowered, so is the cross-bar 42. The cross-bar 42 is mounted to the stabilization post 40 by any suitable means such as by using threaded fasteners or welding. The cross-bar 42 has an upper surface 58 and a lower surface 60.

A foam pad 62 is secured to the lower surface 60 of the cross-bar 42 by an adhesive or mechanical fastener and encircles the stabilization post 40. The foam pad 62 comprises a rectangular foam slab 64 formed from medium or high-density foam having a contoured face opposite the cross-bar 42. The foam slab 64 is wrapped in a covering 66 formed from vinyl, leather, or some other suitable material. The covering 66 is stapled to a wood block 68 and compresses the foam slab 64 between the covering 66 and the wood block 68. The wood block 68 is then secured to the lower surface 60 of the cross-bar 42 by any suitable threaded fasteners. Alternatively, as shown in FIG. 1, the foam pad 62 may comprise a pair of individual foam pad portions 62', 62", each formed identical to the foam pad 62, but smaller in size. The foam pad portions 62', 62" are independently secured to the lower surface 60 of the cross-bar 42 and positioned on opposite sides of the stabilization post 40.

Now, with respect to FIGS. 3 and 4, operation of the exercise apparatus 10 by a wheelchair-bound user 80 is illustrated and described herein by way of example. However, other methods for utilizing the apparatus 10 for LLPS not discussed herein are contemplated without deviating from the scope of the present invention. It is to be appreciated that the apparatus 10 provides means for the user 80 to perform LLPS from the comfort of their own wheelchair. Two areas in which the apparatus 10 provides the greatest treatment is by stretching the user's knees and the user's ankles in order to treat flexion contractures.

In order for the user 80 to treat his or her knee flexion contractures, the apparatus 10 is first positioned in front of an existing pulleyed weight station 82. As shown in FIG. 3, the weight station 82 includes a plurality of weights 84, a rope 86 connected to the weights 84 at a first end thereof, and an ankle strap 88 connected to a second end of the rope 86. The rope 86 and the weights 84 are arranged in a pulley system such that when the ankle strap 88 is pulled in a first direction, the weights 84 are pulled by the rope 86 and raised. Alternatively, when tension on the ankle strap 88 is reduced, gravity causes the weights 84 to be lowered back onto the weight station 82.

The user 80, while seated in his or her wheelchair, is positioned on the base 12 behind the T-shaped structure 14. The cross-bar 42 is lowered onto the user's thighs, just proximal the patella, and applies a slight downward pressure thereto. This prevents any significant flexion of the user's hip joint, thereby isolating the tension and force created by the weights 84 to the user's knee joint.

A clinician or therapist is required to initially select a starting weight 84 and pulls the free, second end of the rope 86 so that the weights 84 are lifted and borne temporarily by the clinician. The ankle strap 88 at the free end of the rope 86 is then attached to the ankle or lower leg of the user 80. Thereafter, the clinician slowly releases his or her hold of the rope 86, which gradually places more and more tension on the user's limbs and provides a tolerable, yet effective stretching force. The user's leg is then held in an extended position, or at least partially extended position, in a passive manner by the weights 84. The clinician uses feedback from the user 80 and clinical reasoning to adjust the weights 84 and duration of the stretch as needed. As noted above, optimal time for holding this position is approximately 20 to 60 minutes, but more or less time may be appropriate.

If necessary, the length of the rope 86 may be cinched or shortened to ensure that the weights 84 are lifted from the weight station 82 based on the range of motion (ROM) of the user's knee. Alternatively, the entire exercise assembly 10 may be moved farther from or closer to the weight station 82 when necessary in order to ensure that the user's leg is extended the appropriate amount to successfully stretch the limb.

As noted above, the exercise apparatus 10 may also be equipped with either one or both of the ankle blocks 24, 24' to facilitate LLPS of the user's ankles suffering from ankle plantar flexion contractures. In doing so, the ankle blocks 24, 24' are positioned within their respective apertures 22, 22' formed in the base 12. The wheelchair-bound user 80 is positioned behind the T-shaped structure 14 and the user's legs are bent to create a 90-degree bend at the knee with the problem ankle placed on top of the respective ankle block 24'.

As shown in FIG. 4, the user's right leg is placed on the right ankle block 24'. The ball of the foot is positioned on or at the rear of the ankle block 24' so that the heel of the foot extends off the rear of the ankle block 24' and is unsupported. The cross-bar 42 is then lowered onto the user's thigh, just above the knee cap, to exert downward pressure onto the user's leg, thereby stretching the ankle joint as the heel of the foot is pushed below the ball of the foot.

The amount of pressure applied by the cross-bar 42 onto the user 80 is determined at the clinician's discretion, but ideally the amount of pressure is enough to cause a passive dorsiflexion moment of the ankle and stretch the posterior elements of the leg and ankle joint. Slight changes in the user's seated position and the resultant hip and knee angles may be made when necessary. The stretching force caused by downward pressure from the cross-bar 42 should be directed grossly parallel to, or in-line with, the user's tibia and perpendicular to the base 12. Similar to the treatment of the knee flexion contractures discussed above, treatment of the ankle plantar flexion contractures using the ankle blocks 24, 24' should consist of constant stretching of the ankle joints for a period of about 20 to 60 minutes, however more or less time may be desired.

From the above, it is to be appreciated that defined herein is a new and unique orthopedic exercise apparatus and method for using same in order to provide low-load prolonged stretching for a wheelchair-bound user exhibiting knee and/or ankle plantar flexion contractures. More importantly, the exercise apparatus allows a wheelchair-bound user to use the apparatus without having to get out of his or her own existing wheelchair and move to a treatment table or other seating member.

One skilled in the art will readily recognize from such discussion, and from the accompanying drawings and claims, that various changes, modifications, and other variations can be made therein without departing from the spirit and fair scope of the disclosed inventive concept as defined by the following claims.

LIST OF REFERENCE NUMERALS

10 Orthopedic exercise apparatus
12 Base
14 T-shaped structure
16 Top sheet of base
16' First top portion
16" Second top portion
18 Upper surface of top sheet
20 Lower surface of top sheet
22 Aperture
22' Aperture
24 Ankle block
24' Ankle block
26 Brick portion
28 Upper surface of ankle block
30 Lower surface of ankle block
32 Peg
34 Hinge
34' Hinge
36 Bottom sheet of base
36' First portion of bottom sheet
36" Second portion of bottom sheet
38 Screw
40 Stabilization post
42 Cross-bar
44 Inner tube
46 Outer tube
48 Holes
50 Pin
52 Top end of stabilization post
54 Bottom end of stabilization post
56 Support bracket
58 Upper surface of cross-bar
60 Lower surface of cross-bar
62 Foam pad
62' Foam pad portion
62" Foam pad portion
64 Foam slab
66 Sheet
68 Wood block
80 User
82 Weight station
84 Weights
86 Rope
88 Ankle strap

What is claimed is:

1. An orthopedic exercise apparatus comprising:

a base including a top sheet and a bottom sheet, said top sheet having an upper surface and a lower surface, said bottom sheet attached to said lower surface of said top sheet;

a T-shaped structure including a stabilization post and a cross-bar, said stabilization post having a first end and a second end, said first end of said stabilization post secured to said upper surface of said top sheet, said cross-bar mounted to said second end of said stabilization post, said cross-bar having a lower surface and a foam pad attached to said lower surface, said stabilization post comprising an inner tube and an outer tube, said inner tube being movably fitted within said outer tube, said inner tube having a plurality of spaced-apart openings formed therein, and said outer tube including a pin positionable within any one of said plurality of spaced-apart openings in said inner tube for adjusting a height of said stabilization post;

a pair of spaced-apart apertures formed in said upper surface of said top sheet; and a pair of ankle blocks, each ankle block including a brick portion having an upper surface and a lower surface and a peg extending downwardly from said lower surface of said brick portion, said peg fitting within an associated one of said spaced-apart apertures.

2. The orthopedic exercise apparatus of claim 1, wherein said top sheet of said base comprises a first top portion and a second top portion joined by a hinge, and further wherein said bottom sheet of said base comprises a first bottom portion and a second bottom portion separate from one another.

3. The orthopedic exercise apparatus of claim 1, wherein said bottom sheet is secured to said top sheet by a plurality of flat headed sheet metal screws, and wherein said plurality of flat headed sheet metal screws lay flat with said upper surface of said top sheet.

4. The orthopedic exercise apparatus of claim 1, wherein said foam pad of said cross-bar includes a first foam pad portion and a second foam pad portion positioned on opposite sides of said stabilization post.

5. The orthopedic exercise apparatus of claim 1, wherein said top sheet is formed from aluminum.

6. The orthopedic exercise apparatus of claim 1, wherein said top sheet is diamond plated.

7. The orthopedic exercise apparatus of claim 1, wherein said bottom sheet is formed from high-density polyethylene.

8. The orthopedic exercise apparatus of claim 1, wherein the pin is spring-loaded.

9. An orthopedic exercise apparatus comprising:

a base including a top sheet having a pair of spaced-apart apertures formed therein and a bottom sheet, said top sheet having an upper surface and a lower surface, said bottom sheet attached to said lower surface of said top sheet;

a pair of ankle blocks removably insertable into said pair of spaced-apart apertures, each ankle block including a brick portion having an upper surface and a lower surface, and a peg extending downwardly from said lower surface of said brick portion, said peg fitting within an associated one of said spaced-apart apertures formed in said top sheet of said base, said peg of each of said pair of ankle blocks has a polygonal geometry corresponding to an associated one of said spaced-apart apertures formed in said top sheet of said base to prevent rotation of said pair of ankle blocks relative to said base; and a T-shaped structure including a stabilization post and a cross-bar, said stabilization post having a first end and a second end, said first end of said stabilization post secured to said upper surface of said top sheet, said cross-bar mounted to said second end of said stabilization post, said cross-bar having a lower surface and a foam pad attached to said lower surface.

10. The orthopedic exercise apparatus of claim 9, wherein said top sheet of said base comprises a first top portion and a second top portion joined by a hinge, and further wherein said bottom sheet of said base comprises a first bottom portion and a second bottom portion separate from one another.

11. The orthopedic exercise apparatus of claim 9, wherein said stabilization post comprises an inner tube and an outer tube, said inner tube being movably fitted within said outer tube, said inner tube having a plurality of spaced-apart openings formed therein, and said outer tube including a spring-loaded pin positionable within any one of said plurality of spaced-apart openings in said inner tube for adjusting a height of said stabilization post.

12. The orthopedic exercise apparatus of claim 9, wherein said top sheet is diamond plated.

13. The orthopedic exercise apparatus of claim 9, wherein said bottom sheet is formed from high-density polyethylene.

14. An orthopedic exercise apparatus comprising:

a base including a top sheet having a pair of spaced-apart apertures formed therein and a bottom sheet, said top sheet having an upper surface and a lower surface, said bottom sheet attached to said lower surface of said top sheet;

a pair of ankle blocks removably insertable into said pair of spaced-apart apertures, said pair of ankle blocks including an upper surface, a lower surface, a front surface, and a rear surface, said front surface and said rear surface extending parallel to one another and extending between said upper surface and said lower surface, said upper surface extending angularly between said front surface and said rear surface relative to said lower surface;

a T-shaped structure including a stabilization post and a cross-bar, said stabilization post having a first end and a second end, said first end of said stabilization post secured to said upper surface of said top sheet, said cross-bar mounted to said second end of said stabilization post, said cross-bar having a lower surface and a foam pad attached to said lower surface.

15. The orthopedic exercise apparatus of claim 14, wherein said top sheet of said base comprises a first top portion and a second top portion joined by a hinge, and further wherein said bottom sheet of said base comprises a first bottom portion and a second bottom portion separate from one another.

16. The orthopedic exercise apparatus of claim 14, wherein said bottom sheet is secured to said top sheet by a plurality of flat headed sheet metal screws, and wherein said plurality of flat headed sheet metal screws lay flat with said upper surface of said top sheet.

17. The orthopedic exercise apparatus of claim 14, wherein said foam pad of said cross-bar includes a first foam pad portion and a second foam pad portion positioned on opposite sides of said stabilization post.

18. The orthopedic exercise apparatus of claim 14, wherein said top sheet is formed from aluminum.

19. The orthopedic exercise apparatus of claim 14, wherein said top sheet is diamond plated.

* * * * *